US009885365B2

(12) United States Patent
Paeng et al.

(10) Patent No.: US 9,885,365 B2
(45) Date of Patent: Feb. 6, 2018

(54) IMPELLER AND METHOD OF MANUFACTURING THE SAME

(71) Applicant: HANWHA TECHWIN CO., LTD., Changwon-si (KR)

(72) Inventors: Ki Paeng, Changwon (KR); Jin-Hyoung Kim, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 1249 days.

(21) Appl. No.: 13/859,912

(22) Filed: Apr. 10, 2013

(65) Prior Publication Data

US 2013/0272883 A1 Oct. 17, 2013

(30) Foreign Application Priority Data

Apr. 17, 2012 (KR) ..... 10-2012-0039969

(51) Int. Cl.

*F04D 29/28* (2006.01)
*B22D 19/00* (2006.01)
*F04D 29/02* (2006.01)

(52) U.S. Cl.

CPC ..... *F04D 29/284* (2013.01); *B22D 19/00* (2013.01); *F04D 29/023* (2013.01); *F05D 2230/21* (2013.01); *F05D 2230/211* (2013.01); *F05D 2300/615* (2013.01)

(58) Field of Classification Search

CPC ..... B22D 19/00; F04D 29/023; F04D 29/284; F05D 2230/21; F05D 2230/211; F05D 2300/615

USPC ..... 416/186 R; 264/299; 29/889, 889.4

See application file for complete search history.

(56) References Cited

U.S. PATENT DOCUMENTS

| | | | | |
|---|---|---|---|---|
| 4,306,833 | A | 12/1981 | Sixsmith et al. | |
| 5,083,903 | A | 1/1992 | Erdmann | |
| 6,062,819 | A | 5/2000 | Zangeneh et al. | |
| 7,070,389 | B2 | 7/2006 | Kim et al. | |
| 7,331,373 | B2 * | 2/2008 | DasGupta | B22D 17/00 164/113 |
| 2005/0225161 | A1 * | 10/2005 | Lowen | B60B 7/14 301/37.371 |
| 2009/0110556 | A1 * | 4/2009 | Jahnz | B22F 3/15 416/179 |
| 2009/0160091 | A1 * | 6/2009 | Zhu | B22C 9/06 264/299 |

(Continued)

FOREIGN PATENT DOCUMENTS

| | | | |
|---|---|---|---|
| JP | 2000-515944 | A | 11/2000 |
| KR | 10-2002-0086142 | A | 11/2002 |

(Continued)

OTHER PUBLICATIONS

Communication issued Feb. 25, 2016, issued by the State Intellectual Property Office of the People's Republic of China in counterpart Chinese Patent Application No. 201310132818.4.

*Primary Examiner* — Mark Laurenzi
*Assistant Examiner* — Paul Thiede
(74) *Attorney, Agent, or Firm* — Sughrue Mion, PLLC

(57) ABSTRACT

A method of manufacturing an impeller includes: providing a disc comprising a plurality of blades, casting a shroud to a first state in a mold, providing a mounting space in the mold, mounting the disc in the mounting space and casting the shroud to a second state with the mounted disc.

9 Claims, 10 Drawing Sheets

(56) References Cited

U.S. PATENT DOCUMENTS

| | | | | |
|---|---|---|---|---|
| 2011/0189440 | A1* | 8/2011 | Appleby | B22C 9/04<br>428/156 |
| 2013/0078099 | A1* | 3/2013 | Ahn | B23K 1/0008<br>416/182 |

FOREIGN PATENT DOCUMENTS

| | | | |
|---|---|---|---|
| KR | 10-2004-0104971 | A | 12/2004 |
| KR | 10-2010-0026828 | A | 3/2010 |

* cited by examiner

IMPELLER AND METHOD OF MANUFACTURING THE SAME

CROSS-REFERENCE TO RELATED PATENT APPLICATION

This application claims priority from Patent Application No. 10-2012-0039969, filed on Apr. 17, 2012, in the Korean Intellectual Property Office, the disclosure of which is incorporated herein by reference in its entirety.

BACKGROUND

1. Field

Apparatuses and methods consistent with exemplary embodiments relate to an impeller used in a rotational apparatus such as a compressor or a pump and a method of manufacturing the impeller, and more particularly to, an impeller including a shroud and a method of manufacturing the impeller.

2. Description of the Related Art

In the related art, a compressor or a pump that compresses fluid includes an impeller that generates turning force.

The impeller transfers rotational motion energy to fluid and increases pressure of the fluid. The impeller includes a plurality of blades on one surface of a disc to move the fluid and transfer the rotational motion energy to the fluid. A shroud for covering the blades on an opposite surface to the disc is installed. The shroud and the blades serve as a moving path of the fluid through the impeller.

When the impeller is manufactured, a method of separately producing the disc including the blades and the shroud and coupling the separately produced disc and the shroud by welding has been used in the related art.

However, such a method incorporating welding and coupling may cause undesirable deformation of the shroud or the blades during the welding process, and such deformation may cause an adverse effect on the quality of the impeller. Further, the welding and coupling method makes it difficult to weld an entire contact part of the shroud and the blades, and the method may cause a problem in a coupling force.

Accordingly, to solve such disadvantages, a new method of manufacturing the impeller is required.

SUMMARY

One or more exemplary embodiments provide an improved impeller having a stably coupled disc including blades and shroud and a method of manufacturing the improved impeller.

According to an aspect of an exemplary embodiment, there is provided a method of manufacturing an impeller, the method including: providing a disc including a plurality of blades; casting a shroud to a first state in a mold; providing a mounting space in the mold; mounting the disc in the mounting space; and casting the shroud to a second state with the mounted disc.

The first state may be a semi-solid state and the second state may be a completely solidified state.

The plurality of blades and the shroud may be coupled to each other after the casting of the shroud to the second state.

The casting of the shroud to the second state comprises cooling the shroud to the completely solidified state.

The mold may include an outer cast and a center cast that form a space corresponding to a shape of the shroud, wherein the casting of the shroud to the first state includes: injecting a melted metal into the space; and cooling the melted metal to a semi-solid state.

The providing of the mounting space may include preparing the mounting space of the disc by removing the center cast.

The method may further include removing the outer cast.

The method may further include polishing a surface of the shroud.

The providing of the disc includes filling a filling material between the plurality of blades.

The filling material may include molding sand.

The method may further include removing the molding sand by beating and breaking the molding sand.

The filling material may include paraffin.

The method may further include removing the paraffin by thermally melting the paraffin.

According to an aspect of another exemplary embodiment, there is provided an impeller including: a disc including a plurality of blades and a shroud contacting and coupled to the plurality of blades, wherein a bonding portion of the plurality of blades and the shroud may include an entire area of a contact surface between the plurality of blades and the shroud.

The bonding portion between the plurality of blades and the shroud may form a round corner.

Ends of the plurality of blades may include a portion embedded into the shroud.

A part of the shroud that contacts the ends of the plurality of blades may protrude toward the plurality of blades.

The part of the shroud that contacts the ends of the plurality of blades may include a round exterior surface.

BRIEF DESCRIPTION OF THE DRAWINGS

The above and/or other features and advantages will become more apparent by describing in detail exemplary embodiments thereof with reference to the attached drawings in which.

DETAILED DESCRIPTION

Figure 1:
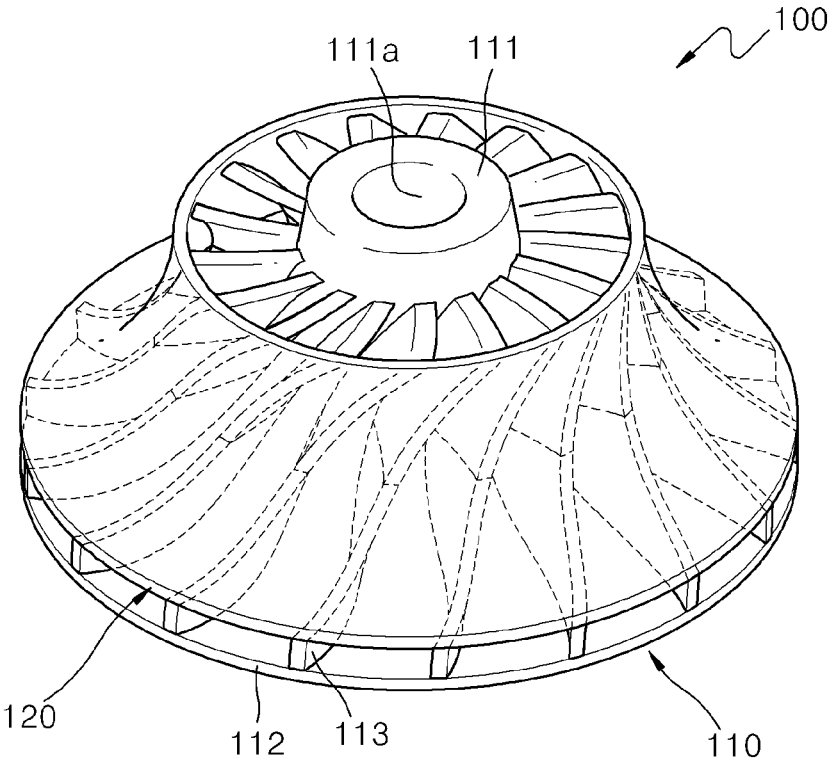
FIG. 1 is a perspective view of a structure of an impeller manufactured by using a method according to an exemplary embodiment.

The present disclosure will now be described more fully with reference to the accompanying drawings, in which exemplary embodiments of the invention are shown. Like reference numerals in the drawings denote like elements, and thus their description will be omitted.

Figure 2:
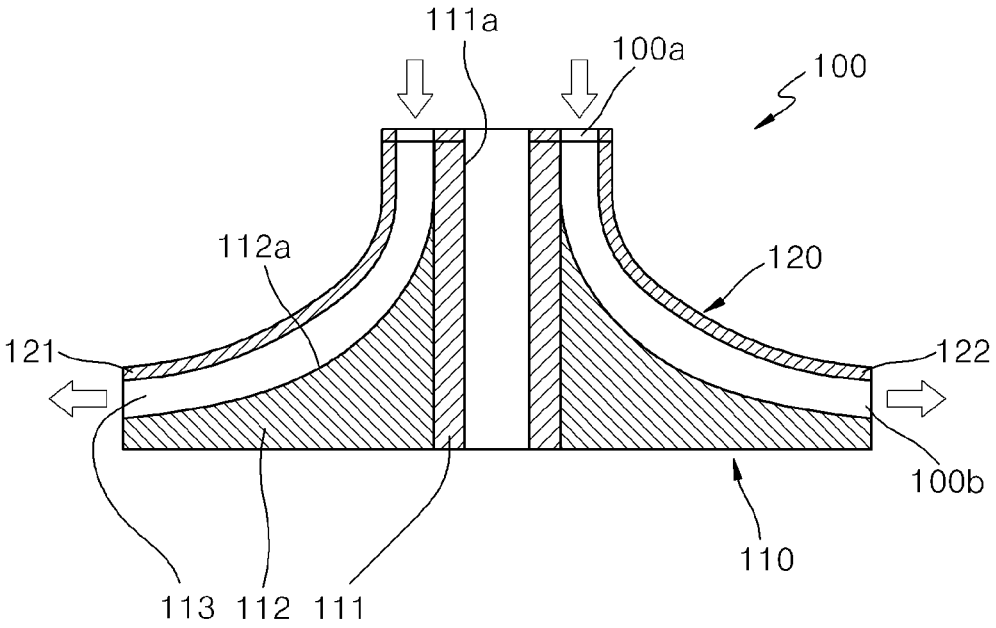
FIG. 2 is a cross-sectional view of the impeller of FIG. 1.

FIG. 1 is a perspective view of a structure of an impeller 100 manufactured by using a method according to an exemplary embodiment. FIG. 2 is a cross-sectional view of the impeller 100 of FIG. 1. FIGS. 3A through 3H are diagrams for sequentially describing a process of manufacturing the impeller 100 according to an exemplary embodiment.

The impeller 100 according to an exemplary embodiment may be used in a rotational machine such as a compressor, a pump, or an air blower, and includes, as shown in FIGS. 1 and 2, a disc 110 that is a main body and a shroud 120 that functions as a cover.

The disc 110 includes an inner core 111, a base unit 112, and a plurality of blades 113.

The inner core 111 is configured to have a circular shape. A mounting hole 111*a* is formed in the center of the inner core 111. An axis of rotation (not shown) is inserted into the mounting hole 111*a* during assembly of the impeller 100 so that the inner core 111 transfers power of the axis of rotation to the impeller 100.

The base unit 112 is positioned at an outer side of the inner core 111. A surface 112*a* of the base unit 112 is configured to have an inclined curve so that the base unit 112 provides a smooth floor surface of a fluid path for a flow of fluid as well as transfers energy to the fluid at the maximum.

The blades 113 are formed on the surface 112*a* of the base unit 112. The blades 113 guide movement of the fluid and transfer a kinetic energy of the impeller 100 to the fluid.

The shroud 120 is bonded to upper portions of the blades 113 and has an umbrella shape having an open center portion and covers the upper portions of the blades 113.

The shroud 120 forms a ceiling surface of the fluid path so that the shroud 120, the base unit 112, and the blades 113 together constitute the moving path of the fluid.

A process of transferring energy to the fluid by using a rotational motion of the above-described impeller 100 will now be described below.

If the axis of rotation rotates, the disc 110 and the shroud 120 of the impeller 100 rotate together.

Accordingly, the fluid is injected into an inlet 100*a* of the impeller 100 in a direction of an arrow of FIG. 2, receives the rotational motion energy, and is ejected to an outlet 100*b* in a high pressure state. Thereafter, the velocity of the fluid which passes through a diffuser (not shown) decreases, and the pressure of the fluid increases to a desired level.

The method of manufacturing the impeller 100 according to an exemplary embodiment will now be described with reference to FIGS. 3A through 3G.

Figure 3A:
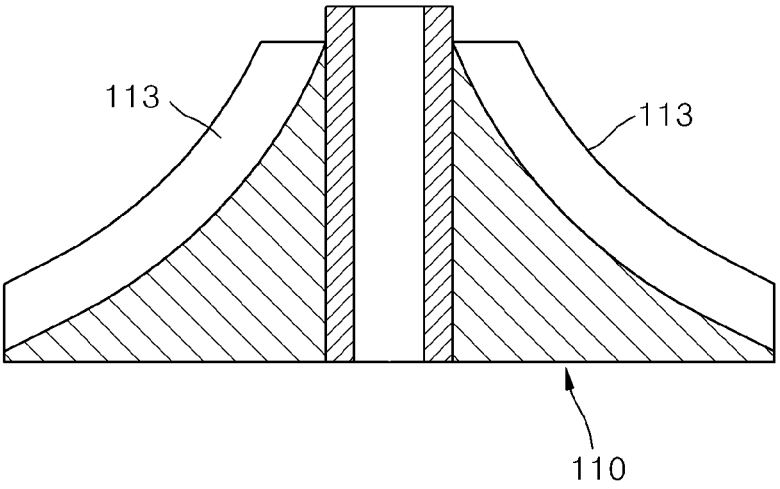
FIGS. 3A through 3H are diagrams for sequentially describing a process of manufacturing an impeller according to an exemplary embodiment.

A disc 110 including blades 113 is prepared as shown in FIG. 3A. The disc 110 including the blades 113 may be produced through mechanical processing in the same manner as the related art manufacturing process. The disc 110 and the blades 113 may made from a ferrous metal such as carbon steel or a nonferrous metal such as aluminum.

Figure 3B:
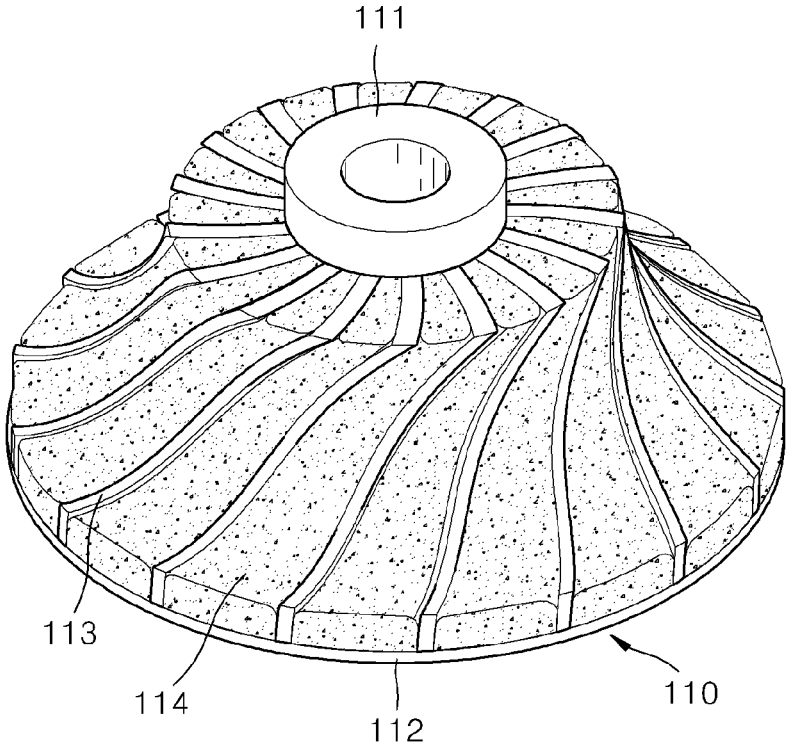

Thereafter, as shown in FIG. 3B, molding sand 114 is filled in areas between the blades 113 of the disc 110 as a filling material.

Figure 3C:
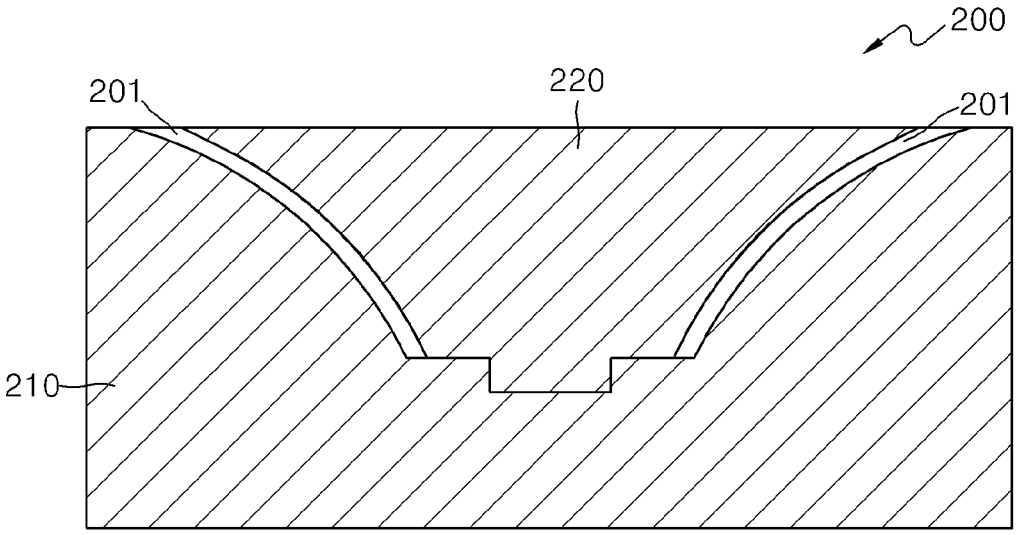

Then, as shown in FIG. 3C, a mold 200 which includes an empty space 201 and corresponds to a shape of a shroud 120 is prepared. The mold 200 includes a center cast 220 and an outer cast 210. The empty space 201 between the center cast 220 and the outer cast 210 corresponds to the shape of the shroud 120.

Figure 3D:
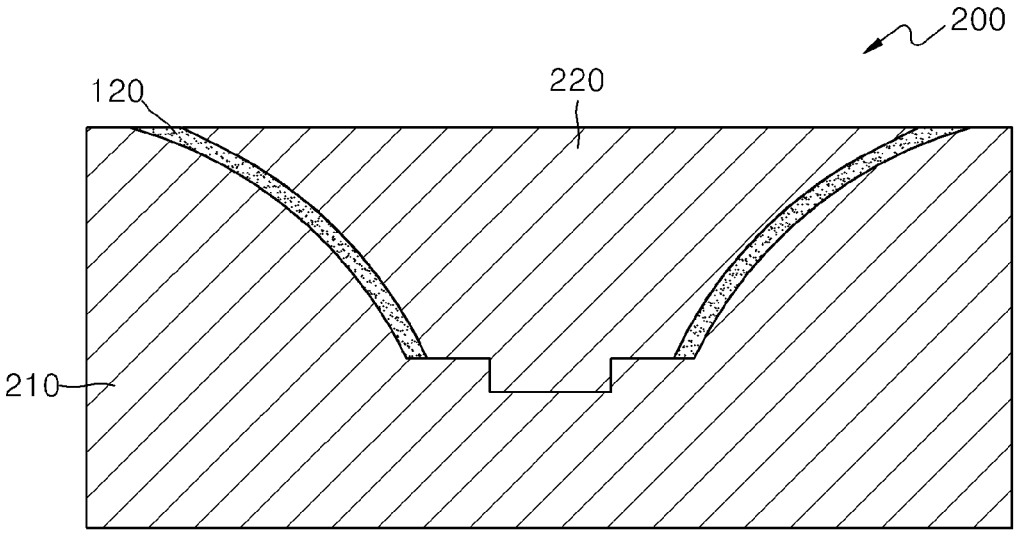

After the mold 200 is prepared, as shown in FIG. 3D, a melted metal is injected into the empty space 201 to proceed with a first casting operation of casting the shroud 120. The melted metal may comprise the ferrous metal such as carbon steel or the nonferrous metal such as aluminum as described above. Then, the melting metal filled in the empty space 201 is cooled down and thus the shroud 120 is slowly casted. In this process, the cooling down process is not performed to a point where the melting metal is completely solidified but rather only to a point where the melting metal is halfway solidified in such a way that the shape of the shroud 120 is not crumbled during the first casting operation.

Figure 3E:
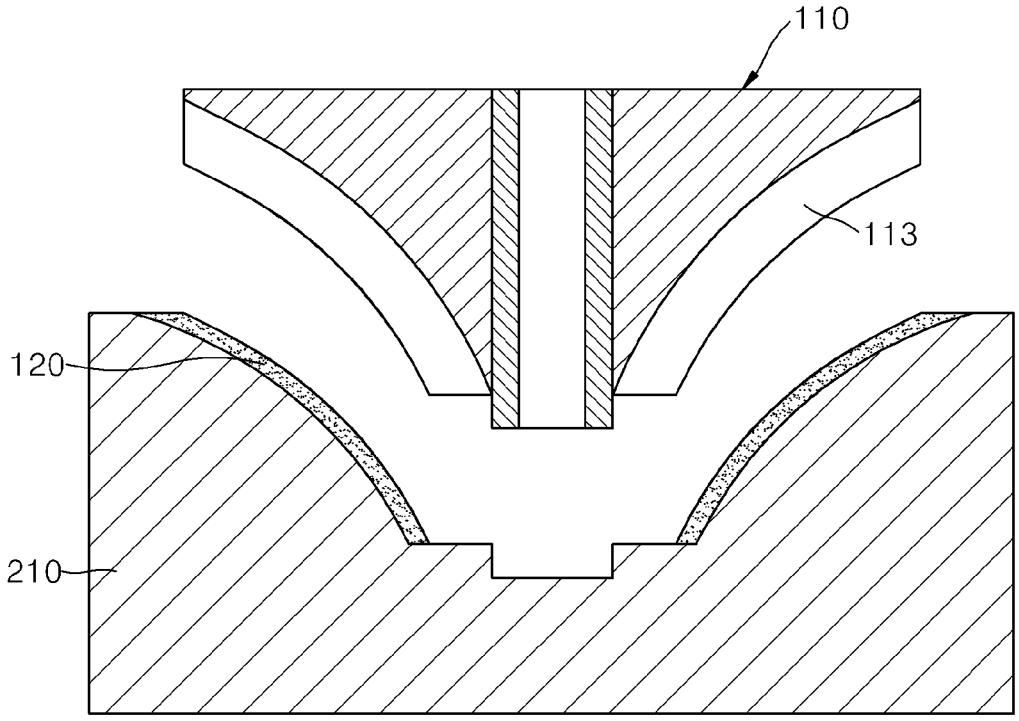

Then, as shown in FIG. 3E, the center cast 220 of the mold 200 is removed, and the disc 110 including the blades 113 is mounted in the mold 200 from which the center cast 220 is removed.

Figure 3F:
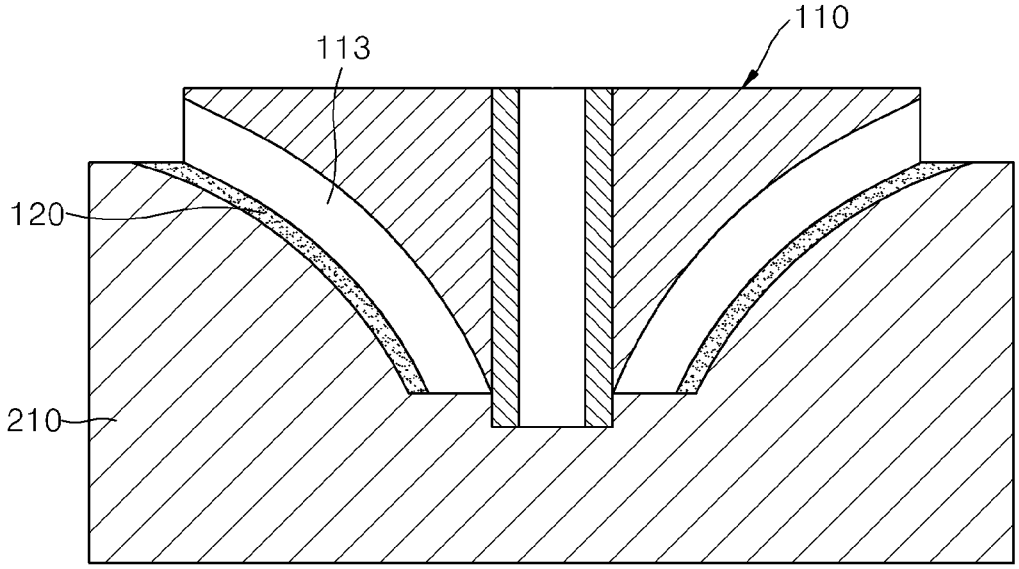

Accordingly, the blades 113 of the disc 110 are tightly adhered to the shroud 120 in a semi-solid state as shown in FIG. 3F. The molding sand 114 that is the filling material is filled between the blades 113 so that the shroud 120 in the semi-solid state may not invade therebetween. Then, a second casting operation of cooling the shroud 120 is performed until the shroud 120 is completely solidified, and the blades 113 and the shroud 120 that contact each other are firmly bonded to each other as the shroud 120 is solidified.

Figure 3G:
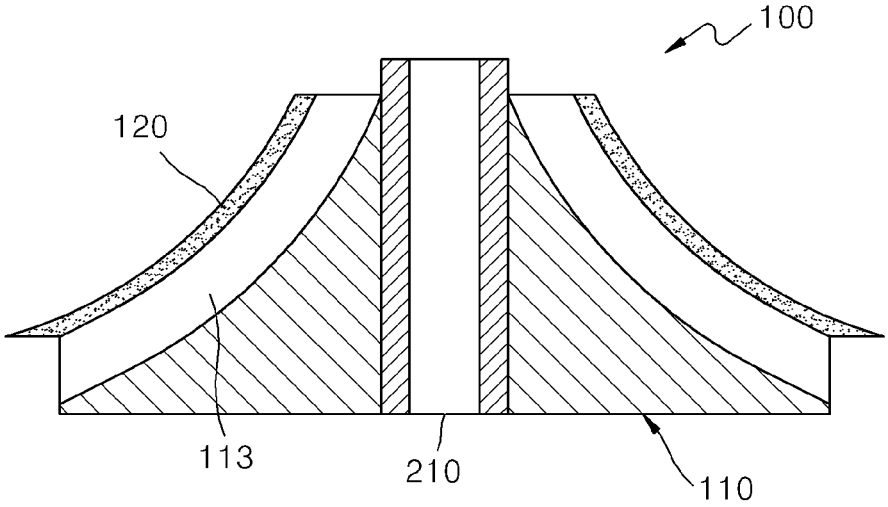

Finally, if the outer cast 210 is removed and the molding sand 114 filled between the blades 113 is removed, as shown in FIG. 3G, the impeller 100 in which the blades 113 and the shroud 120 are firmly bonded to each other is manufactured. Subsequently, a process of polishing a surface of the shroud 120 may be additionally performed.

Therefore, if the impeller 100 is manufactured by using the above-described method, the blades 113 and the shroud 120 in the semi-solid state contact each other and the blades 113 and the shroud 120 are bonded to each other as the shroud 120 is solidified. This exemplary method reduces undesirable deformation during a manufacturing process compared to a welding and bonding method of the related art, and thus the impeller 100 having very stable quality is manufactured.

Figure 3H:
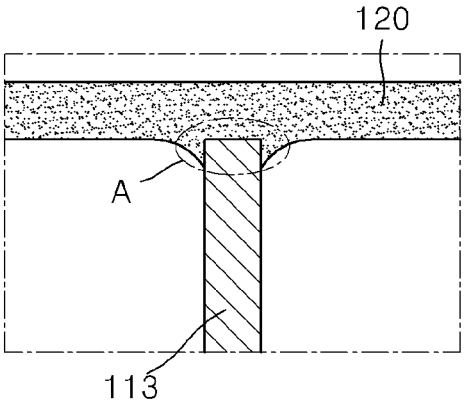

Further, the welding and bonding method of the related art may have a weak bonding force since bonding occurs only in a part on which welding is actually performed, whereas a casting method according to the present exemplary embodiment tightly bonds an entire contacting part between the blades 113 and the shroud 120 by embedding ends of the blades 113 into the shroud 120, and thus the impeller 100 having a very excellent bonding strength may be manufactured compared to a impeller of the related art. In particular, as shown in FIG. 3H, a bonding part A between the blades 113 and the shroud 120 having a round corner shape is advantageous to obtaining a stable coupling force. A part of the shroud 120 that contacts both sides of the ends of the plurality of blades 113 protrudes toward the plurality of blades and the part of the shroud 120 that contacts both sides of the ends of the plurality of blades has a round exterior surface.

If the molding sand 114 is appropriately filled in an area between the blades 113, the method according to the present exemplary embodiment easily forms the round corner. Thus, the above-described method provides a very advantageous effect in obtaining the bonding force between the blades 113 and the shroud 120.

Although the first casting operation performed on the shroud 120 is performed after the disc 110 is prepared in the present exemplary embodiment, to the contrary, the disc 110 may be prepared during the half solidifying process of the first casting operation. That is, the disc 110 is not necessarily prepared before the first casting operation is performed, and the disc 110 may well be prepared before the second casting operation is performed.

A method of manufacturing the impeller 100 according to another exemplary embodiment will now be described with reference to FIGS. 4A through 4G. The same reference numerals denote the same elements between the previous exemplary embodiment and the present exemplary embodiment.

Figure 4A:
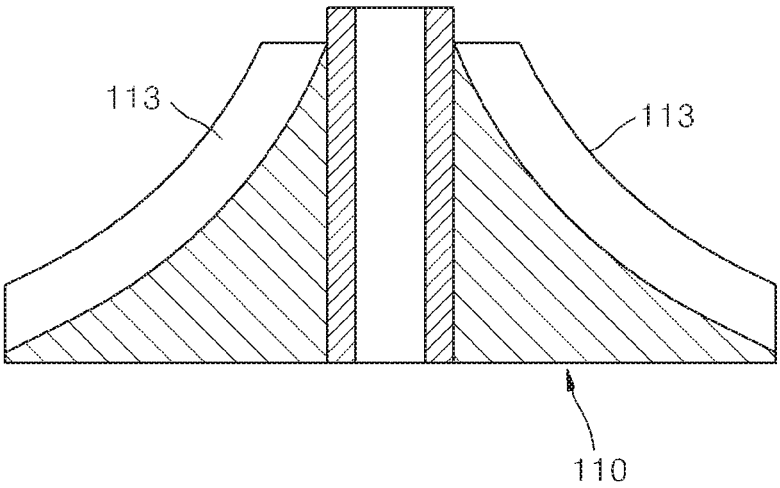
FIGS. 4A through 4H are diagrams for sequentially describing a process of manufacturing an impeller according to another exemplary embodiment.

As shown in FIG. 4A, a disc 110 including blades 113 is prepared. The disc 110 and the blades 113 may use a ferrous metal such as carbon steel or a nonferrous metal such as aluminum.

Figure 4B:
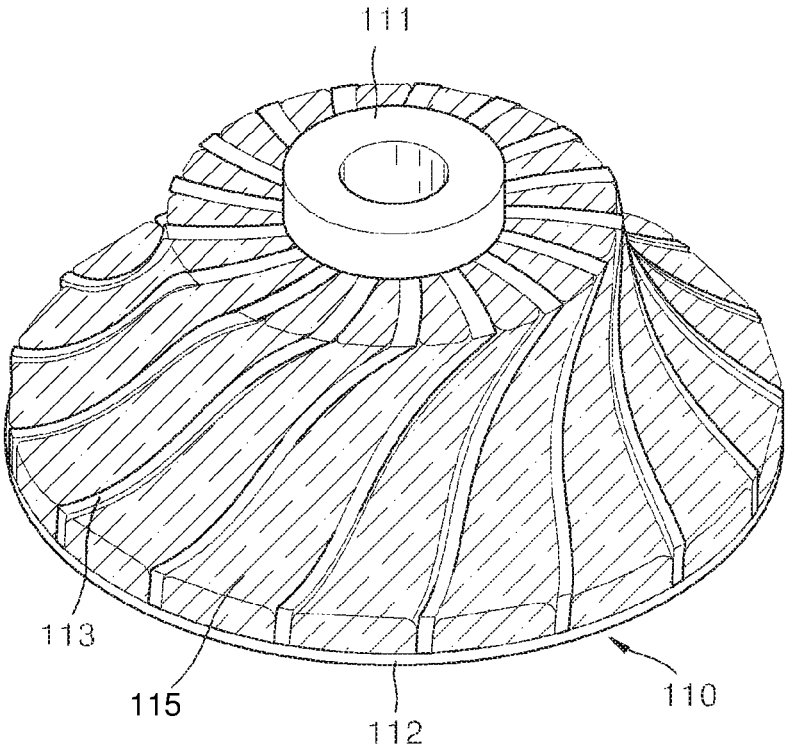

Thereafter, as shown in FIG. 4B, a filling material is filled between areas between the blades 113 of the disc 110. Paraffin 115 is used as the filling material. That is, although sand (114, see FIG. 3B) is used as the filling material in the previous embodiment, the paraffin 115 that may be thermally melted and removed is used as the filling material in the present exemplary embodiment.

Figure 4C:
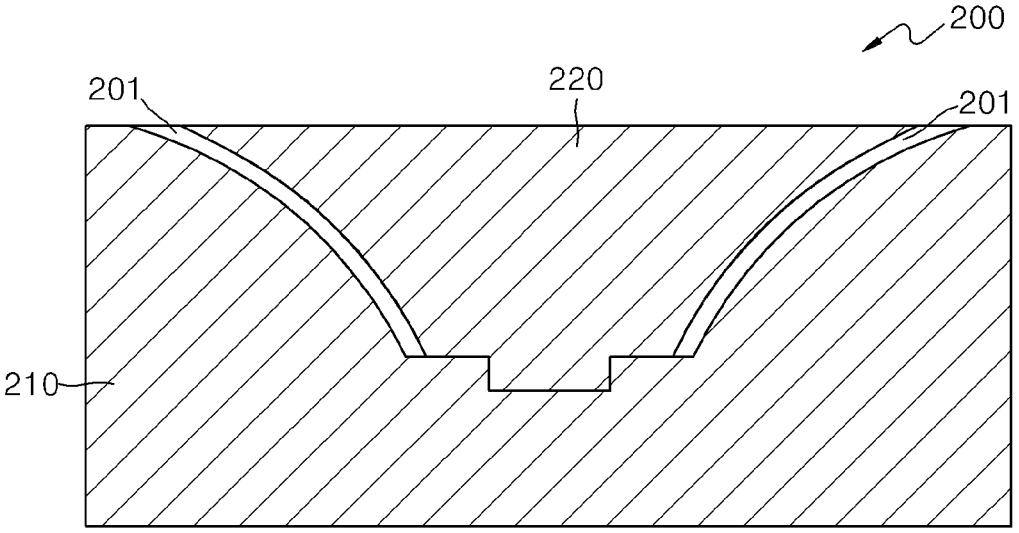

Thereafter, as shown in FIG. 4C, a mold 200 including an empty space 201 corresponding to a shape of the shroud 120 is prepared. The mold 200 includes a center cast 220 and an outer cast 210. The empty space 201 between the center cast 220 and the outer cast 210 corresponds to the shape of the shroud 120.

Figure 4D:
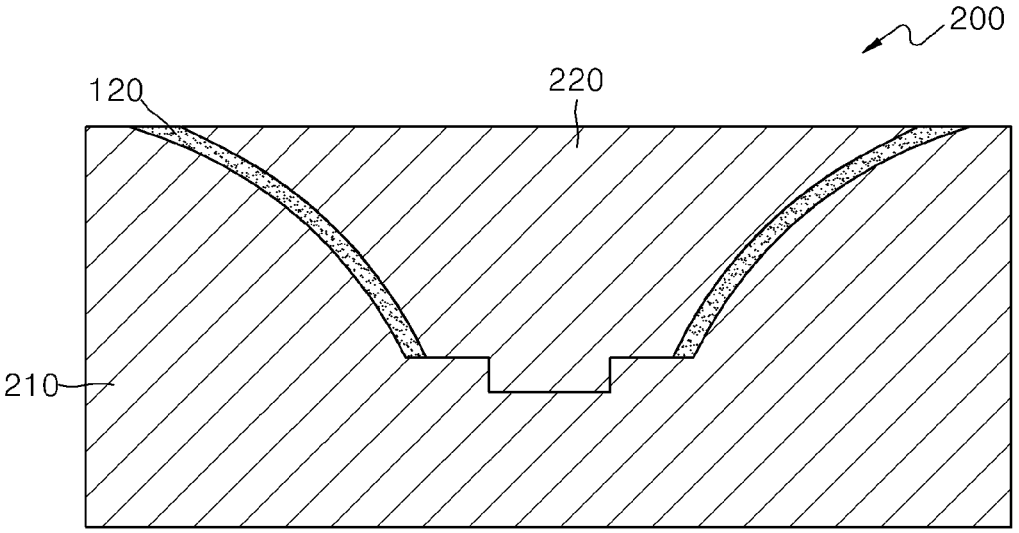

If the mold 200 is prepared, as shown in FIG. 4D, a melted metal is injected into the empty space 201 to proceed with a first casting operation of casting the shroud 120. The melted metal may use the ferrous metal such as carbon steel or the nonferrous metal such as aluminum. Then, the melted metal filled in the empty space 201 is cooled and thus the shroud 120 is slowly casted. In this process, cooling is not performed to a point where the melted metal is completely solidified but rather only to a point where the melted metal is halfway solidified in such a way that the shape of the shroud 120 is not crumbled during the first casting operation.

Figure 4E:
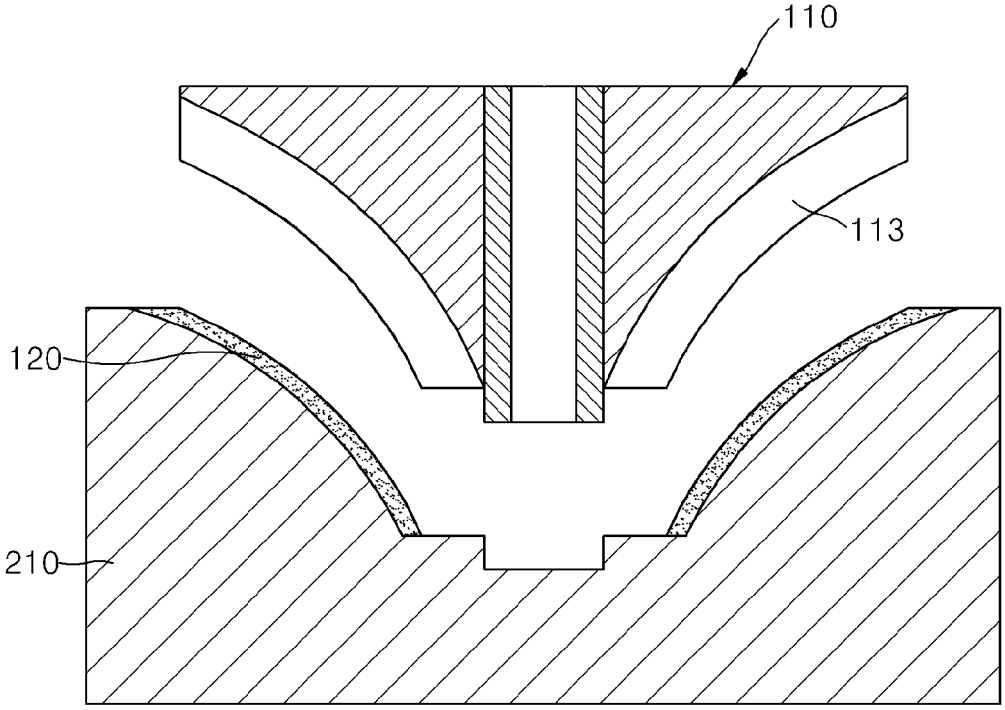

Then, as shown in FIG. 4E, the center cast 220 of the mold 200 is removed, and the disc 110 is mounted in the mold 200 from which the center cast 220 is removed.

Figure 4F:
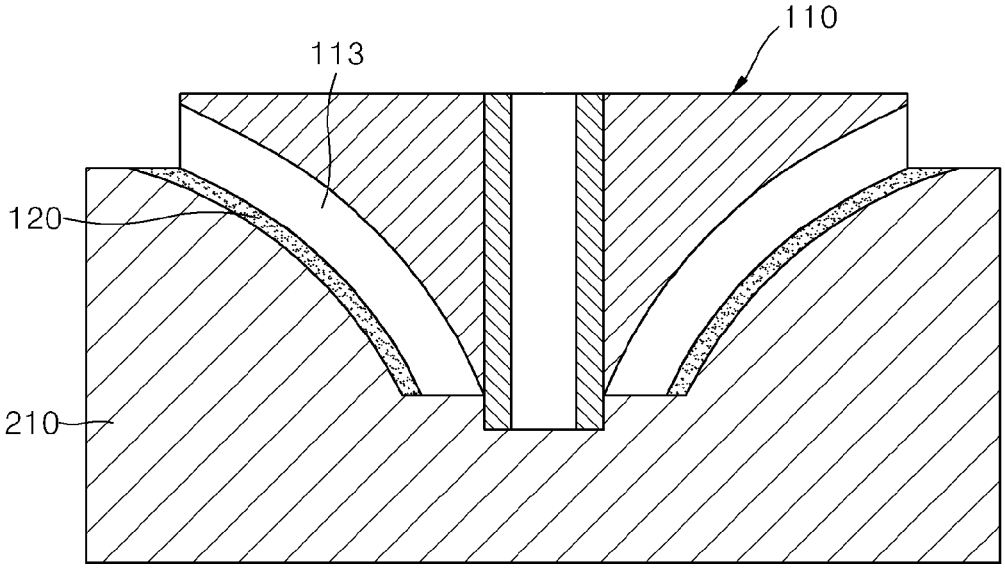

Accordingly, the blades 113 of the disc 110 are tightly adhered to the shroud 120 in a semi-solid state as shown in FIG. 4F. Here, the paraffin 115 that is the filling material is filled between the blades 113 so that the shroud 120 in the semi-solid state may not invade therebetween. A second casting operation of cooling the shroud 120 is performed until the shroud 120 is completely solidified. Then, the blades 113 and the shroud 120 that contact each other are firmly bonded to each other as the shroud 120 is solidified.

Figure 4G:
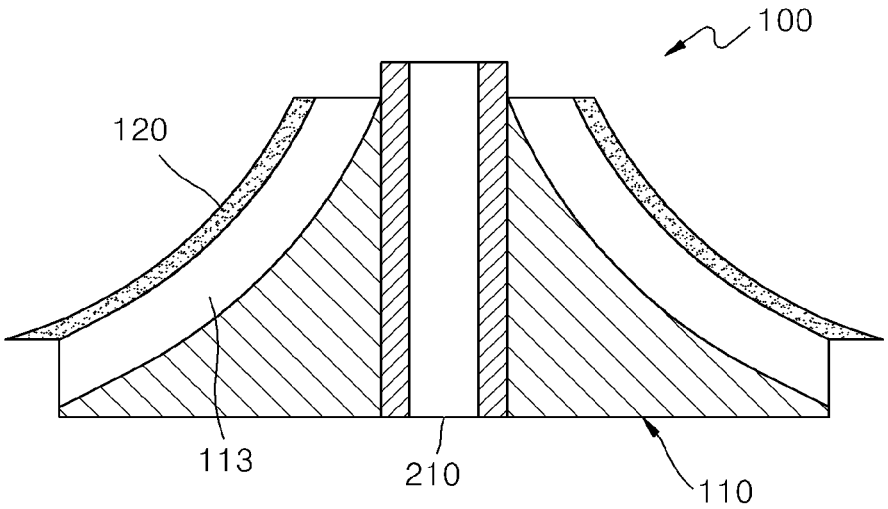

Finally, if the outer cast 210 is removed and the paraffin 115 filled between the blades 113 is removed, as shown in FIG. 4G, the impeller 100 in which the blades 113 and the shroud 120 are firmly bonded to each other is manufactured, and then, a process of polishing a surface of the shroud 120 may be additionally performed. The paraffin 115 may be thermally melted and removed. That is, the molding sand 114 is used as the filling material in the previous exemplary embodiment and thus the filling material may be beaten lightly, broken, and removed, whereas the paraffin 115 is used as the filling material in the present embodiment and thus the filling material may be thermally melted and removed.

If the impeller 100 is manufactured by using the above-described method, the blades 113 and the shroud 120 in the semi-solid state contact each other and are bonded to each other as the shroud 120 is solidified. This method reduces a unwanted deformation during the manufacturing process compared to a conventional welding and bonding method, and thus the impeller 100 having very stable quality is manufactured.

Figure 4H:
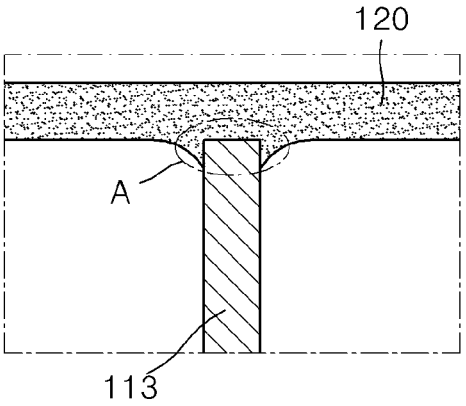

Further, a welding and bonding method of the related art causes a weak bonding force since bonding is carried out only in a part in which welding is actually performed, whereas a casting method according to the present exemplary embodiment tightly bonds an entire bonding part between the blades 113 and the shroud 120 by embedding ends of the blades 113 into the shroud 120, and thus the impeller 100 having a very excellent bonding strength may be manufactured compared to an impeller of the related art. In particular, as shown in FIG. 4H, the bonding part A between the blades 113 and the shroud 120 in a round corner shape is advantageous to obtaining a stable coupling force. As shown FIG. 4H, a part of the shroud 120 that contacts both sides of the ends of the plurality of blades 113 protrudes toward the plurality of blades and the part of the shroud 120 that contacts both sides of the ends of the plurality of blades has a round exterior surface. If the paraffin 115 is appropriately formed, the method according to the present exemplary embodiment is very advantageous in forming the round corner. Thus, the above-described method provides a very advantageous effect in obtaining a stronger bonding force.

Although the first casting operation performed on the shroud 120 is performed after the disc 110 is prepared in the present exemplary embodiment, to the contrary, the disc 110 may be prepared during the halfway solidifying process of the first casting operation. That is, the disc 110 is not necessarily prepared before the first casting operation is performed and the disc 110 may well be prepared before the second casting operation is performed.

According to an impeller and a method of manufacturing the impeller of exemplary embodiments, an undesirable deformation of a bonding part of blades and a shroud may be minimized, and a bonding strength therebetween may be increased.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A method of manufacturing an impeller, the method comprising:

providing a disc comprising a plurality of blades;

injecting a melted metal into a shroud forming space of a mold, and cooling the melted metal to a semi-solid state to form a shroud in the semi-solid state;

providing a mounting space in the mold;

mounting the disc in the mounting space to couple the plurality of blades to the shroud in the semi-solid state in a contacting manner; and cooling the shroud to a completely solidified state to bond the shroud with the plurality of blades, wherein the mold comprises an outer cast and a center cast that form the shroud forming space corresponding to a shape of the shroud.

2. The method of claim 1, wherein the providing of the mounting space comprises preparing the mounting space of the disc by removing the center cast.

3. The method of claim 2, further comprising removing the outer cast.

4. The method of claim 1, further comprising polishing a surface of the shroud.

5. A method of manufacturing an impeller, the method comprising:

providing a disc comprising a plurality of blades;

injecting a melted metal into a shroud forming space of a mold, and cooling the melted metal to a semi-solid state to form a shroud in the semi-solid state;

providing a mounting space in the mold;

mounting the disc in the mounting space to couple the plurality of blades to the shroud in the semi-solid state in a contacting manner; and cooling the shroud to a completely solidified state to bond the shroud with the plurality of blades, wherein the providing of the disc comprises filling a filling material between the plurality of blades.

6. The method of claim 5, wherein the filling material comprises molding sand.

7. The method of claim 6, further comprising removing the molding sand by beating and breaking the molding sand.

8. The method of claim 5, wherein the filling material comprises paraffin.

9. The method of claim 8, further comprising removing the paraffin by thermally melting the paraffin.

* * * * *